US007607195B2

(12) United States Patent
Tagliaferri

(10) Patent No.: US 7,607,195 B2
(45) Date of Patent: Oct. 27, 2009

(54) CLEANING UNIT OF ROADS AND THE LIKE

(75) Inventor: Fabrizio Tagliaferri, Trecasali (IT)

(73) Assignee: Dulevo International S. p. A., Sanguinaro di Fontanellato (Parma) (IT)

( * ) Notice: Subject to any disclaimer, the term of this patent is extended or adjusted under 35 U.S.C. 154(b) by 261 days.

(21) Appl. No.: 11/543,350

(22) Filed: Oct. 5, 2006

(65) Prior Publication Data

US 2007/0079471 A1 Apr. 12, 2007

(30) Foreign Application Priority Data

Oct. 7, 2005 (EP) ..... 05425703

(51) Int. Cl.
*E01H 1/08* (2006.01)

(52) U.S. Cl. ..... 15/340.1; 15/347; 15/346

(58) Field of Classification Search ..... 15/340.1, 15/45, 347, 352, 353, 78, 83; *E01H 1/08; A47L 5/00*
See application file for complete search history.

(56) References Cited

U.S. PATENT DOCUMENTS 3,540,073 A * 11/1970 Issenmann et al. ..... 15/352
4,099,290 A 7/1978 Hiszpanski et al.
4,160,302 A * 7/1979 Hirst et al. ..... 15/347
4,554,701 A * 11/1985 Van Raaij ..... 15/347
4,570,287 A 2/1986 Kerschener et al.
4,754,521 A * 7/1988 Zoni ..... 15/340.1
2007/0157421 A1* 7/2007 Imao et al. ..... 15/340.1

FOREIGN PATENT DOCUMENTS

WO WO 2005/024138 A1 3/2005

* cited by examiner

*Primary Examiner*—Dung Van Nguyen
(74) *Attorney, Agent, or Firm*—R. Ruschena Patent Agent, LLC

(57) ABSTRACT

A cleaning unit is disclosed, comprising: a containment chamber (2) defining an accumulation base (10), a suction apparatus (3) including a suction inlet (6) positioned close to the ground, and a filtering apparatus (12), the suction apparatus (3) comprising primary suction means (4) and secondary suction means (5) positioned in parallel to one another above the accumulation base (10), the primary suction means (4) controlling said suction inlet (6) and the secondary suction means (5) being suitable to expel filtered air, and the containment chamber (2) including separating element (9) which separates the turbulent zone (5*a*), the air inside of which being highly turbulent, and a recirculation zone (4*a*), the air inside of which having a low turbulence, the recirculation zone (4*a*) being connected to the primary suction means (4) and the turbulent zone (5*a*) being connected to the secondary suction means (5).

12 Claims, 2 Drawing Sheets

CLEANING UNIT OF ROADS AND THE LIKE

FIELD OF THE INVENTION

The present invention relates to a cleaning unit for roads and the like of the type comprising: a containment chamber defined by an accumulation base, a suction apparatus including a suction inlet positioned close to the ground, and a filtration apparatus, the suction apparatus being suitable to recycle the air between the containment chamber and the suction inlet.

DESCRIPTION OF THE PRIOR ART

As it is known, there are currently on the market different types of road cleaning units and the like, used for cleaning roads, squares, large shopping areas and other areas.

The basic components of these units are: a refuse conveyance apparatus, a separation filter of the refuse and pollutants and a container for the storage of the refuse. These units can operate dry or with water.

They suck air, the refuse and pollutants such as dust and the like, that are subsequently separated, by means of a special filter, and the refuse and pollutants are then stored, thereby cleaning the road surface.

The conveyance of the substances is performed in the mechanical-suction type units by means of special rotating brushes and mechanical conveyors, and in other units especially through the use of a pressurized air flow that skims the ground to create, according to concepts known in fluid dynamics, a surface vacuum that allows the refuse and pollutants that adhere to the ground to be lifted.

The pressurized air can, for example, come from the recycled air of the suction apparatus, this air already having a notable kinetic energy, and a reduced energy cost is sufficient to create the flow of pressurized air.

A similar unit is described in the U.S. Pat. No. 4,099,290, wherein the sucked air is partially filtered and recycled.

Said filtered air is also partially collected and filtered again to be discharged into the environment.

The above mentioned technique presents some important drawbacks.

In fact, the air under pressure, that with its action at ground level causes the refuse to rise, normally presents a large load of dusts an pollutants. Therefore a pollution is caused each time this recycled air is dispersed into the environment.

Despite the fact that the devices that are used are normally designed in such a way to allow an efficient recycling of the air used to lift the substances from the ground with little load loss, the air itself cannot be totally recycled, due to the unevenness of the ground and normal loss of load.

Otherwise, using purified air to lift the pollutants from the ground is not convenient, because, during the described operation, the purified air mix again with the pollutants and therefore need to be purified again with notable waste of energy and operating time.

Furthermore, said devices require frequent maintenance, cleaning and more. Buildups of refuse and the like can also occur inside said units, which could cause possible and hazardous proliferation of bacteria or the like, or simply the deterioration of the functioning conditions.

In addition, frequent cleaning of the filters or their replacement is necessary.

It is also necessary to interrupt the functioning of the unit to perform the cleaning of the filters or of the unit itself.

The cleaning and maintenance of said unit cause a rise in costs and operating times.

Furthermore, the devices currently on the market are not always able to process pollutants present in the environment, such as fine dust and toxic particles.

SUMMARY OF THE INVENTION

In this situation, the technical aim that is the basis of the present invention is that of conceiving a cleaning unit for roads and the like capable of substantially overcoming the drawbacks stated in the prior art.

Within said technical aim is an important purpose of the invention to conceive a cleaning unit that allows to remove pollutants and retain them without releasing them into the environment.

Another important aim of the invention is to conceive a cleaning unit that allows a rapid and infrequent maintenance of the unit itself.

Another aim of the invention is that of creating a cleaning unit of roads and the like that allows the cleaning operation of the filters and the like is to be performed without the interruption of use of the machine itself.

The technical aim and specified objectives are attained by a cleaning unit of roads and the like, comprising: a containment chamber defined by an accumulation base, a suction apparatus including a suction inlet positioned close to the ground, and a filtration apparatus; said suction apparatus being suitable to recycle the air between said containment chamber and said suction inlet and including primary suction means and secondary suction means positioned in parallel to one another and above said accumulation base; said primary suction means controlling said suction inlet and said secondary suction means being suitable to expel filtered air; and said containment chamber including a separation element that separates a turbulent zone, in which exists air with a high level of turbulence and energy, and a recirculation zone, in which exists air with a low level of turbulence and energy; said recirculation zone being connected to said primary suction means and said turbulent zone being connected to said secondary suction means.

Said cleaning unit allows the recycling of air that contains few pollutants and it is simply and economically managed.

BRIEF DESCRIPTION OF THE DRAWINGS

Additional characteristics and advantages of the invention are explained further below by the detailed description of a preferred embodiment of the invention, with reference to the attached drawings, in which.

DESCRIPTION OF THE PREFERRED EMBODIMENTS

Figure 1:
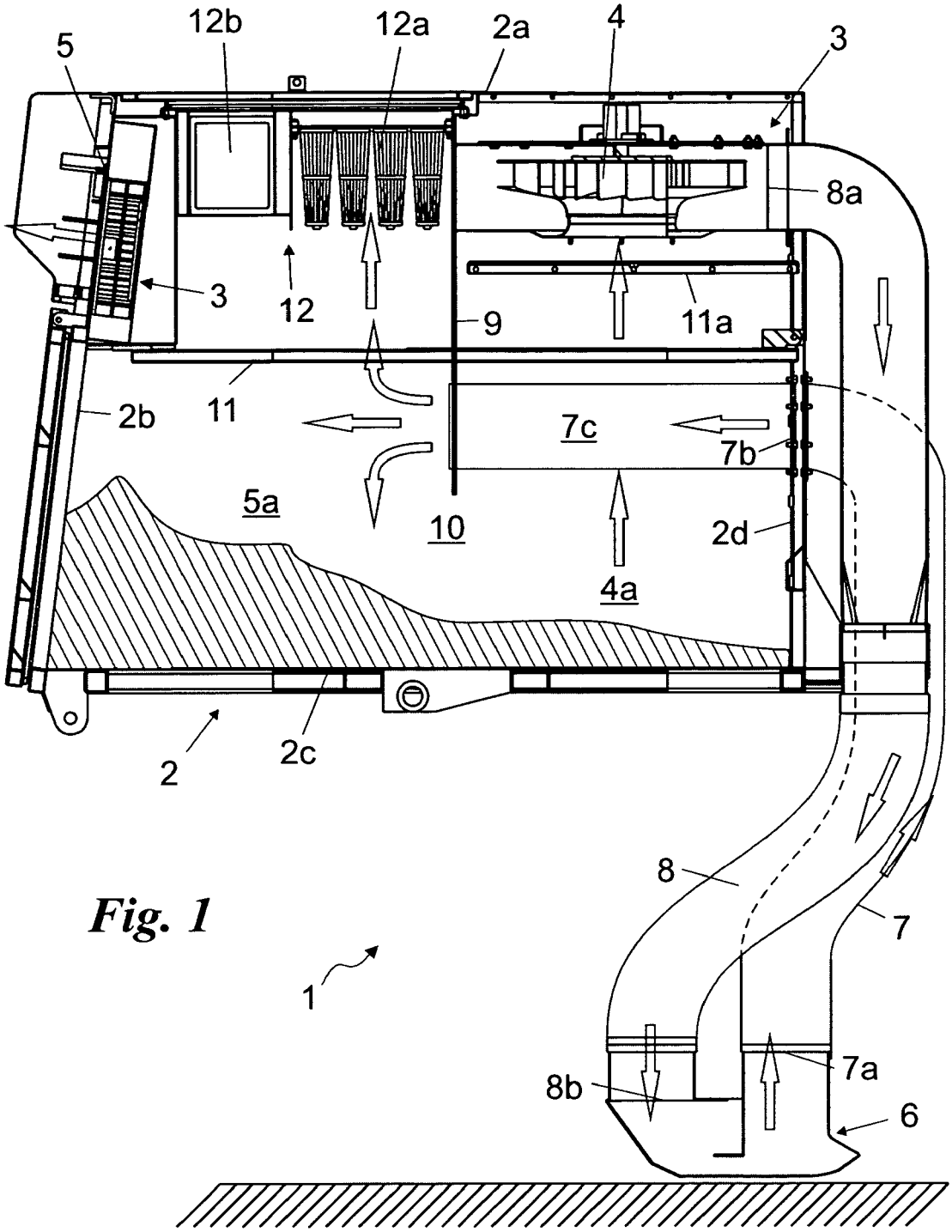
FIG. 1 illustrates a section of the unit according to the invention.
Figure 2:
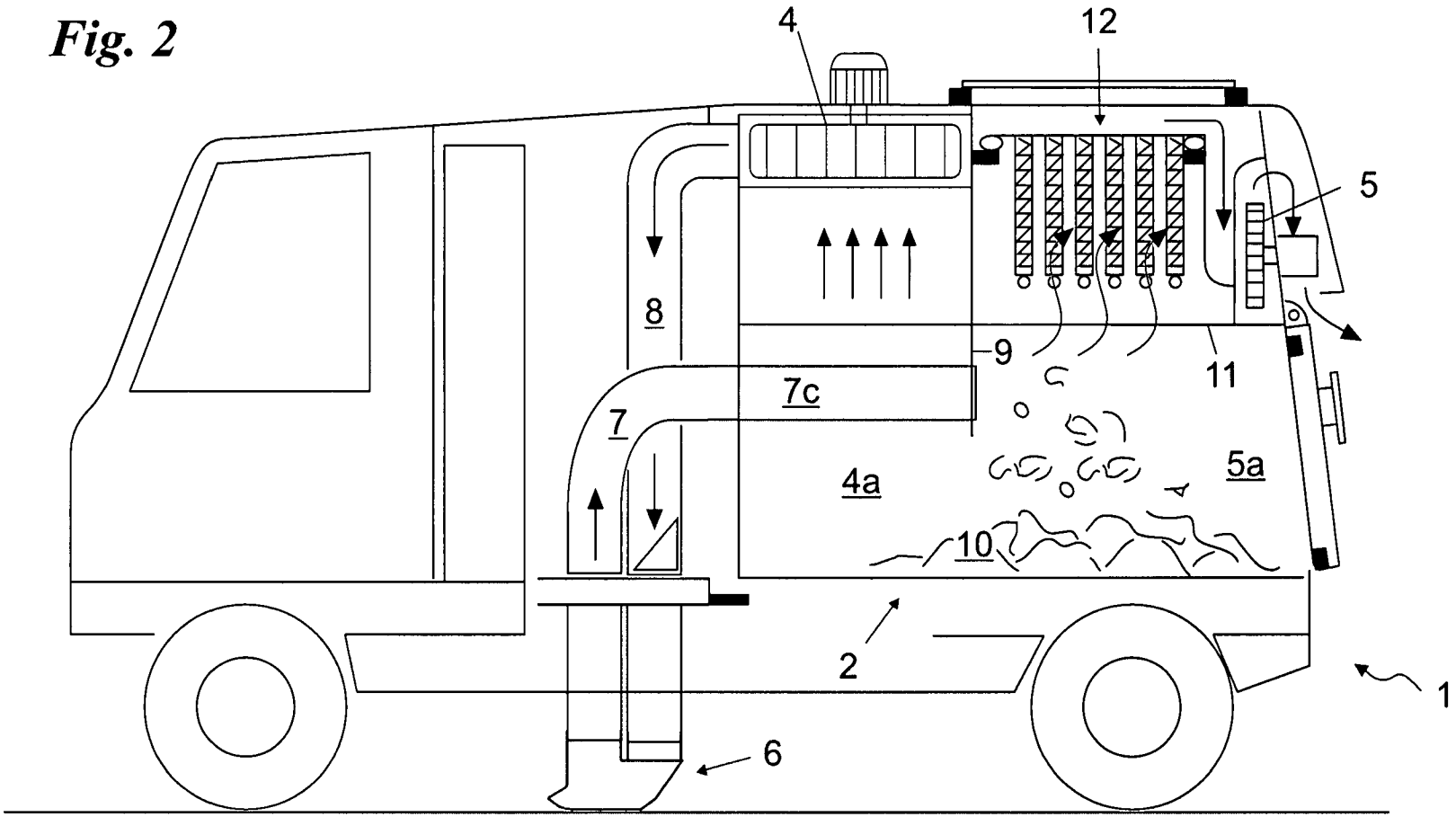
FIG. 2 illustrates the unit according to the invention placed on a motorized vehicle.

With reference to the attached figures, the cleaning unit according to the invention is indicated, as a whole, with the number 1.

This is a kind that is transportable on trucks, vans and the like and includes a containment chamber 2 duly and substantially of a parallelepiped form or the like and constructed of sheet metal or the like. Said containment chamber 2 is at least made up in part by: an upper wall 2*a*, a rear wall 2*b*, that can at least be opened or removed in part, a front wall 2*d*, a base wall 2*c* and two side walls.

These walls are preferably and substantially flat, without considering alterations of the wall planarity, any ribs or reinforcing angles of said walls.

The lower section of the chamber 2 is designed to the containment of the refuse and pollutants. Therefore, the base 2*c* and the lower sections of the side walls, front wall 2*d* and rear wall 2*b*, create an accumulation base 10 for the storage of said refuse and pollutants.

Unit 1 also includes a suction apparatus 3, that sucks air, pollutants, such as dust and the like, and refuse, which are larger in size than sad pollutants, from the ground.

Said suction apparatus includes primary suction means 4 and secondary suction means 5 positioned in parallel.

The primary and secondary suction means 4 and 5 are positioned in the upper section of said containment chamber 2, above the accumulation base 10.

In particular, the primary suction means 4 are preferably made up by a centrifugal fan positioned parallel and close to the upper wall 2*a* of the containment chamber 2.

The secondary suction means 5 are preferably made up by two parallel operating axial-flow fans. These axial-flow fans 5 are positioned in parallel to the rear wall 2*b* of the containment chamber 2 and close to both the said rear wall 2*b* and the upper wall 2*a*.

Both the primary suction means 4 and the secondary suction means 5, in parallel to each other, work together to create a vacuum in the containment chamber 2 and at the same time an ample movement of the air. In particular, the primary suction means 4 have a greater capacity than the secondary suction means 5. For example, the primary means 4 have a capacity equal to 60%-70% of the total, while the secondary means 5 have a capacity equal to 30%~40% of the total.

Furthermore, a separation means 9 is also present that essentially separates a recirculation zone 4*a*, in which the action of the primary suction means 4 is prevalent, by a turbulent zone 5*a*, in which the action of the secondary suction means 5 is prevalent.

The separation means 9 is preferably made up by a section of wall.

The separation means 9 can be variously shaped and dimensioned.

The suction apparatus 3 includes a suction inlet 6, which sucks said air, pollutants and refuse from the outside, more precisely from the ground.

Said suction inlet 6 is duly positioned below said containment chamber 2.

The suction apparatus 3 also includes a suction duct 7 that channels said air, pollutants and refuse, to transport them from the suction inlet 6 to the accumulation base 10.

This suction duct 7 is essentially made up by tubes or the like positioned inside said containment chamber 2, that therefore bend from an inlet 7*a* in correspondence with the suction inlet 6 to an outlet 7*b* positioned in the containment chamber 2.

The outlet 7*b* is then connected to conveyance means 7*c*, preferably made up by a simple extension of the duct 7, or by other elements such as guide bulkheads, that convey the refuse close to the centre of the containment chamber 2, towards the turbulent zone 5*a* of the chamber itself.

The suction apparatus 3 also includes an air recirculation duct 8, which channels the air of the chamber 2 to the suction inlet 6.

This recirculation duct 8 is also mainly made up by tubes or the like that expand outside the chamber 2 and it includes an inlet 8*a*, positioned close to the primary suction means 4, and an outlet 8*b*. The tubing or the like of this outlet 8*b* narrows so as to create a pressurized air flow that skims the ground that, according to the known Venturi effect, helps the detachment of the pollutants from the ground and their suction.

The unit 1 also includes a filtration element 11 that filters the refuse sucked by both the primary suction means 4 and the secondary suction means 5.

The filtration element 11 is preferably made up by a net or grid, positioned above said accumulation base 10. This net preferably has mesh diameter between 8 mm and 10 mm, so as to prevent the refuse exiting from the accumulation base. Due to the simplicity of said filtration element 11, it does not require any cleaning or maintenance operation.

The unit 1 also includes a filtration apparatus 12 that filters the pollutants that are sucked by the secondary suction means 5.

Therefore the filtration apparatus 12 retains the dusts and other particles dispersed in the environment.

This apparatus 12 is essentially made up by at least one cloth filter 12*a*, or a cartridge filter, cylindrical or conical, or bags.

Both of these types of filter are based on a filtering cloth that is placed around a conical or cylindrical cartridge, or is positioned following a layout with several loops or sacks.

These filters convey the air through the filtering cloth that retains it. These filters are also positioned, in particular in conical cartridge and sack models, in such a manner that the gravitational force pushes the pollutants that accumulate on the surface towards the accumulation base 10.

Not all pollutants fall immediately in the accumulation base 10, but some of them deposit on the surface of the filtering cloth.

The progressive deposit of pollutants on the filtering cloth makes periodic cleaning of the cloth necessary, which is performed automatically through the shaking of the filtering cloth, or alternatively by means of washing, compressed air, or the like.

Furthermore, a fine filter 12*b*, such as an electrostatic type, is preferably positioned in series to the filtering cloth 12*a*, which sterilizes by means of the ionization of the air, which is created by the presence of a strong electrostatic field. Thereby, the pollutants assume an electrical charge and deposit on the walls of the filter. The walls can then be either manually or automatically cleaned.

Alternatively, an absolute fine filter 12*b*, also made of filtering sloth, can be positioned in series to the filtering cloth 12*a*, but this one is made with a very fine cloth that filters the finest pollutants.

The fine filter 12*b* is also positioned above the accumulation base 10 and therefore the pollutants that are discharged from said filter, fall and deposit directly onto the accumulation base 10, after having passed the filtration element 11.

Once the dusts have fallen into the accumulation base 10, they deposit and adhere to the refuse, especially if they are damp as quite often is the case. Therefore, they are not sucked up again by the suction apparatus 3.

The fine filter 12*b* is furthermore positioned next to the secondary suction means 5, so that they convey the filtered air into the environment.

The functioning of the cleaning unit according to the invention, structurally described above, is as follows.

On starting, the suction system 3 is activated, or rather the primary and secondary suction means 4 and 5 are started at the same time in parallel. In this manner a vacuum is created in the chamber 2.

Due to said vacuum, the suction inlet 6 draws in the air, refuse and pollutants from the ground. These pass through the suction duct 7 and arrive to the containment chamber 2.

The refuse is detained by the filtering device 11 and fall into the accumulation base 10.

The suction means 4 and 5 are such that they are capable of lifting also heavy refuse and of creating a current of air with a flow that reaches a speed of 60 m/s.

The air that exits the outlet 7*b* and the conveyance means 7*c* is introduced into the turbulent zone 5*a*.

This turbulent zone 5*a* is therefore affected by the presence of air being highly turbulent and having a great kinetic energy.

This air is mainly sucked by the nearby secondary suction means 5.

This is then filtered by the filtering apparatus 12, and looses the pollutants that it contains. It is then expelled and put into the environment.

Filtration is performed by both the cloth filter 12*a*, that removes the larger pollutants, as well by the fine filter 12*b* that removes the finer pollutants.

The air that arrives to the recirculation zone 4*a* has passed throughout the entire containment chamber 2. The recirculation zone 4*a* is therefore characterised by a reduced turbulence and energy, due also to the loss of power.

Furthermore, only part of the air introduced by the conveyance means 7*c* arrives in the recirculation zone 4*a*, because part of this air is sucked and expelled by the secondary suction means 5.

Therefore, this air is less likely carrying the pollutants that all into the accumulation base 10.

Therefore, the primary suction means 4 suck air that contains fewer pollutants. The air is carried through the recirculation duct 8 and arrives to the outlet 8*b* close to the suction inlet 6.

Here the air laps the ground at high speed, thereby creating the Venturi effect, which allows the removal of dust and the like. The air subsequently returns, through the suction duct 7, to the chamber 2.

Based on the capacity of the primary and secondary suction means 4 and 5, different amounts of air can be recycled or filtered and then expelled into the environment.

The cloth filter 12*a* is automatically shaken and cleaned after it has reached its maximum capacity, the pollutants thereby falling into the accumulation base 10.

The absolute or electrostatic fine filter 12*b*, which is also positioned above the accumulation base 10, requires less maintenance.

The invention provides significant advantages.

One significant advantage is given by the particular and innovative layout of the filtering apparatus 12, by the primary suction means 4 and the secondary suction means 5.

These are all in fact positioned in the upper section of a single containment chamber 2, which is preferably of a very simple shape, such as a parallelepiped for example. Consequently, the unit 1 is simply and economically managed.

The suction and recirculation ducts 7 and 8 respectively, are mainly positioned outside the containment chamber 2.

This layout prevents the undesired and hidden accumulation of pollutants and refuse. The unit 1 does not have areas or gaps that would favour this accumulation.

Possible malfunction or power loss or similar of the primary and secondary suction means 4 and 5 cause the pollutants or refuse to fall directly into the accumulation base 10.

An additional advantage of the layout of said equipment inside the containment chamber 2 and the ducts positioned mainly outside the chamber, allow the chamber 2 to be easily adapted to a different type of cleaning unit, by simply removing part of the elements contained within. For example, the simple removal of the primary suction means 4 and ducts 7 and 8 allows using the containment chamber 2, with its filters and with the secondary suction means 5, to create a mechanical-suction type cleaning unit, where the refuse is also conveyed by mechanical conveyors.

The primary suction means 4 and the secondary suction means 5 operate simultaneously in parallel: the power of the suction means is therefore compounded and the total suction has a greater efficiency.

In spite of the layout of said components in a single containment chamber 2, the air used for the recirculation contains low quantities of dust and pollutants due to the differentiation of the suction zones of said components. Therefore, the unit 1 does not release a relevant amount of pollutants into the environment, even when the suction inlet 6 has difficulty in adhering to the ground.

At the same time, unit 1 allows a rapid and continual flow of air and does not filter the same air more than once.

The special type of filters and their position above the accumulation base 10, allow them to be automatically cleaned and the settling of the pollutants, freed from the filters, directly into the accumulation base 10.

Therefore, frequent maintenance of the filters is not necessary.

The particular layout of the filtering cloth and electrostatic or absolute filters that are arranged in series, also allows even very fine particles to be filtered (up to 0.01 μm) that are a health hazardous and that cannot be filtered by other types of filter. This layout and selection of filters is particularly suitable and can be used also in the absence of pneumatic conveyance and recirculation of the airflow.

The invention is subject to variations that fall within the inventive concept.

For example, a second filtering element 11*a*, made up by a grid or a net, can be positioned immediately below the primary suction means 4, between the separation element 9 and the front wall 2*c*.

Furthermore, mechanical conveyance members, such as a conveyor belt and a brush, can be integrated to the suction of the refuse and pollutants, inside the suction duct 7.

What I claim is:

1. Cleaning unit of roads and the like, comprising:

a containment chamber (2) defined by an accumulation base (10), a suction apparatus (3) including a suction inlet (6) positioned close to the ground, and a filtration apparatus (12), said suction apparatus (3) being suitable to recycle the air, between said containment chamber (2) and said suction inlet (6), and including primary suction means (4) and secondary suction means (5) positioned in parallel to one another and above said accumulation base (10), said primary suction means (4) controlling said suction inlet (6) and said secondary suction means (5) being suitable to expel filtered air, and said containment chamber (2) including a separation element (9) that separates a turbulent zone (5*a*), in which exists air with a high level of turbulence and energy, and a recirculation zone (4*a*), in which exists air with a low level of turbulence and energy, said primary suction means (4) being placed in said recirculation zone (4*a*) and said secondary suction means (5) being placed in said turbulent zone (5*a*).

2. Unit according to claim 1, wherein said suction apparatus (3) includes a suction duct (7) and conveyance members (7*c*) suitable to channel said air, refuse and pollutants from said inlet (6) to said turbulent zone (5*a*), and a recirculation duct (8), suitable to channel said air from said recirculation zone (4*a*) to said inlet (6), in a manner to aid the suction of said pollutants.

3. Unit according to claim 2, wherein said conveyance members (7*c*) are defined by an extension of said suction duct (7), and wherein said conveyance members (7*c*) pass through said suction element (9).

4. Unit according to claim 1, wherein said suction apparatus (3) includes a suction duct (7) and a recirculation duct (8), and wherein said suction (7) and recirculation ducts (8) are outside said containment chamber (2).

5. Unit according to claim 1, wherein said separation element (9) is made up by a vertical wall section.

6. Unit according to claim 1, wherein said primary suction means (4) have a capacity between 60% and 70% of the total and said secondary suction means (5) have a capacity between 30% and 40% of the total.

7. Unit according to claim 1, having a filtration element (11) which extends in said containment chamber (2) in such a manner so as to filter refuse sucked by said primary suction means (4) as well as said secondary suction means (5), and in which said filtering apparatus (12) is suitable to filter said refuse and said pollutants sucked by said secondary suction means (5).

8. Unit according to claim 7, wherein said filtration element (11) is made up by a net having a mesh opening between 8 mm and 10 mm.

9. Unit according to claim 1, wherein said filtering apparatus (12) includes a filtering cloth filter (12*a*).

10. Unit according to claim 9, in which said filtering apparatus (12) includes an absolute filter (12*b*) placed in series to said filtering cloth filter (12*a*).

11. Unit according to claim 9, wherein said filtering apparatus (12) includes an electrostatic filter placed in series to said filtering cloth filter (12*a*).

12. Unit according to claim 1, comprising a second filtering device (11*a*) positioned between said filtering device (11) and said primary suction means (4).

* * * * *